United States Patent [19]

Burnside

[11] 4,190,066

[45] Feb. 26, 1980

[54] COIN AND PAPER MONEY PAYOUT SYSTEM

[75] Inventor: Walter M. Burnside, Waukegan, Ill.

[73] Assignee: Bally Manufacturing Corporation, Chicago, Ill.

[21] Appl. No.: 864,928

[22] Filed: Dec. 27, 1977

[51] Int. Cl.[2] ..... G07D 1/00

[52] U.S. Cl. ..... 133/4 R; 194/2; 221/129

[58] Field of Search ..... 133/1 R, 2, 4 R; 194/2; 221/92, 124, 129

[56] References Cited

U.S. PATENT DOCUMENTS

| | | | |
|---|---|---|---|
| 3,242,929 | 3/1966 | Adams | 133/4 R X |
| 3,285,380 | 11/1966 | Sykes | 194/2 |
| 3,527,238 | 9/1970 | Stamp | 133/4 R |

*Primary Examiner*—Joseph J. Rolla
*Attorney, Agent, or Firm*—Callard Livingston

[57] ABSTRACT

Coin handling apparatus operative to pay out selectively presettable numbers of coins and automatically substitute paper money when the number of coins called for exceeds some arbitrary limit whereby risk of depleting the supply of coins by a succession of large withdrawals is alleviated, or alternatively to dispense some predetermined number of coins or an equivalent or other denomination of paper money or tickets depending on the adjustment of a value-setting switch.

8 Claims, 11 Drawing Figures

74X
SETTING MEANS
118
120
119
122
121
123
117
60X
VALUE SWITCH
62X
63X
64X
67X
66X
65X
93BX
89
59X
116
AWARD RELAY
DISPENSING SIGNAL
91X

COIN AND PAPER MONEY PAYOUT SYSTEM

The invention relates to coin dispensing and control apparatus and provides a method and apparatus operative in a system for paying out either coinage or paper money depending upon whether or not the number of coins required to be dispensed exceeds a predetermined number, whereby the supply of coins will not be depleted by a possible succession of large withdrawals before the reserve supply can be replenished by intervening deposits, or to dispense coins or bills which may be in equivalent amounts.

In current practice, machines for paying out tokens and coins in coin counting, change making and like machines will employ one or the other of two general types of coin dispenser, the first being the so-called hopper type in which the coins are picked up one by one by a rotating transport disc from a bulk collection in a large hopper of high capacity, and delivered serially to a discharge station, while being counted in the process, in order to effect automatic termination of the dispensing operation when the tally reaches a certain count; the second type of dispenser being the so-called tube type wherein the coins are stacked in a vertical tube and successively ejected or released at the bottom by some form of ejector slide or gate, this type of dispenser having considerably less capacity and speed than the hopper type, but being subject, like the hopper, to premature depletion of the coin supply by a succession of large withdrawals at a single operation.

In accordance with the invention coin payouts in excess of a predetermined large number of coins, determined as an arbitrary precautionary limit, are avoided by a method and apparatus operating in a system which automatically converts the payout from hard coin to paper money, that is to say bills or bank notes, of predetermined denomination equivalent to the amount which otherwise would have to be dispensed in coins.

In a preferred arrangement, bills of suitable denomination will be lodged in some form of carrier or container, for example, a cartridge of uniform character suitable for containment in a magazine, the optional or conversion payout being effected by means of control circuitry governed by a pre-set value switch normally determinative of the number of coins required to be dispensed in any given cycle of operation of the system, and which, on being set for a number of coins in excess of the predetermined limit, will shift the payout command to a bill-dispensing subcircuit effecting ejection of one or more bill-containing cartridges of equivalent value, or in some cases possibly of higher value dependently upon the setting of the value switch, as will be more fully explained hereafter.

The detailed character of the invention utilitarian advantages thereof will be more fully evident from the following description of a preferred embodiment thereof taken in view of the annexed drawings in which:

FIG. 1 is a front perspective view of the bill-dispensing unit employed in the system;

FIG. 1-A is a perspective detail of the carrier-ejecting rocker;

FIG. 1-B is a perspective detail of one of the bill-carriers;

Figure 1:
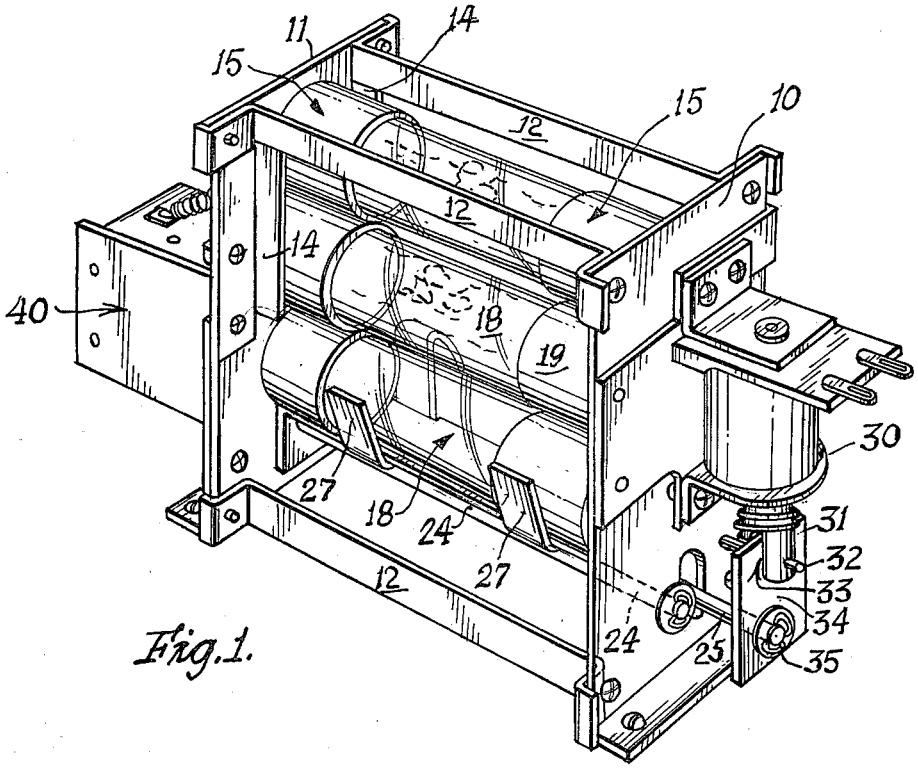

Referring to FIG. 1, the bill dispensing means comprises a magazine formed by opposite end plates 10 and 11 rigidly interconnected by tie bars 12 which are of a width and location preferably leaving large open areas at the sides of the magazine substantially unobstructed so that the bill carriers or cartridges 18 lodged therein can be viewed.

Figure 5:
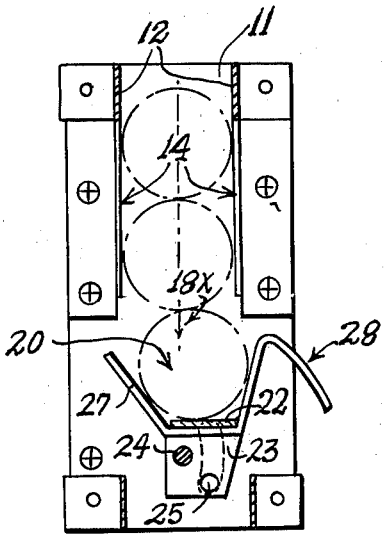
FIGS. 5 and 6 are similar sectional views through the dispensing unit illustrating the normal and ejecting positions of the bill carrier ejecting means in dispensing action.
Figure 6:
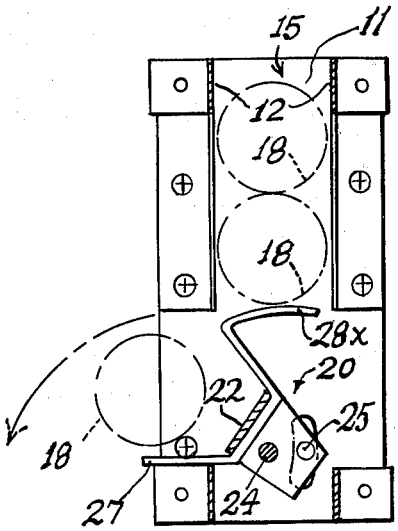

On the inner faces of the end plates are pairs of spaced angle brackets 14 defining vertical cartridge guiding channels 15 in which the opposite ends of cylindrical cartridges 18 are received, as seen in FIGS. 5 and 6 particularly, said ends being fitted with caps 19, FIG. 1-B.

Figure 7:
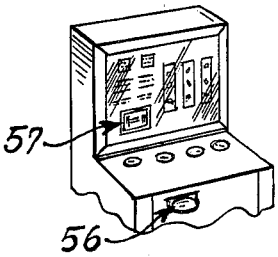
FIG. 7 is a fragmentary view of a form of cabinet in which the dispensing apparatus may be used.

The cartridges 18 may take the preferred form of a cylindrical tube of transparent plastics material having a diameter suitable for rolling of the bills for easy insertion and removal with some identifiable portion, such as the denomination, visible to the observer through the transparent walls thereof, for observation through the open area of the magazine and through a window in the machine cabinet which houses the associated dispensing apparatus, as shown in FIG. 7, as at the window 57.

The loaded bill-containing carriers or cartridges 18 are stacked in the magazine channels 15 in such number as may be necessary for the particular service for which the dispensing apparatus is intended, the magazine being accordingly adapted in capacity to enlargement in the vertical direction to accommodate any number of cartridges by simply adding above the basic unit another set of end plates and tie bars of appropriate dimensions.

Means for ejecting the bill cartridges one at a time from the bottom of the magazine comprises a rockable ejector cradle 20 which may take the form depicted in FIG. 1-A consisting of a simple stamping including a horizontal seating section 22 having opposite downturned end flanges 23 perforated to engage and rock upon a pintle rod 24 seated at opposite ends in the respective end plates 10 and 11 and constituting the entire pivotal support for the cradle. Eccentric control studs 25 and 26 each project respectively from one of the opposite end flanges on the cradle, as in FIGS. 2, 5 and 6, for actuating and lockout purposes, as will appear.

Referring to FIGS. 1-A and 5, the rockable ejecting cradle 20 includes near each end a pair of angularly offset cartridge-retaining projections or fingers 27, 28 adapted to flank the opposite sides of the lowermost cartridge lodged on the seating portion 22 so that the cartridge will be captured for purposes of sidewise ejection from the stack when the ejector is rocked from its normal position of FIG. 5 to the discharge position seen in FIG. 6, it being observed in FIG. 5 that the angular disposition of the said flanking fingers projections 27, 28 is such that in the normal position of the ejector, the lowermost cartridge is lodged slightly off-center, as at 18X, relative to a vertical center line through the remaining cartridges above, by reason of the pitch of finger portions 27, while the opposite companion finger portions 28 are pitched at a lesser angle such that the initial push imparted to the lowermost cartridge at the start of the ejecting action will tend to elevate the next higher cartridge slightly and prevent it from dropping until the trailing curved extension 28X thereof can move beneath and support the remaining cartridges while the bottom cartridge is being ejected, all with minimal loading upon the actuating mechanism, to be described, and minimized potential for jamming.

Figure 2:
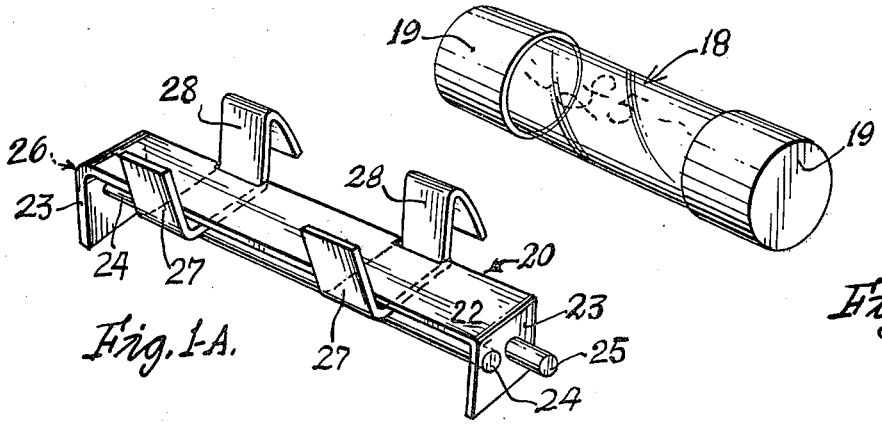
FIG. 2 is a rear elevation of the bill-dispensing unit depicted in FIG. 1 but with the bill carriers removed.
Figure 2:
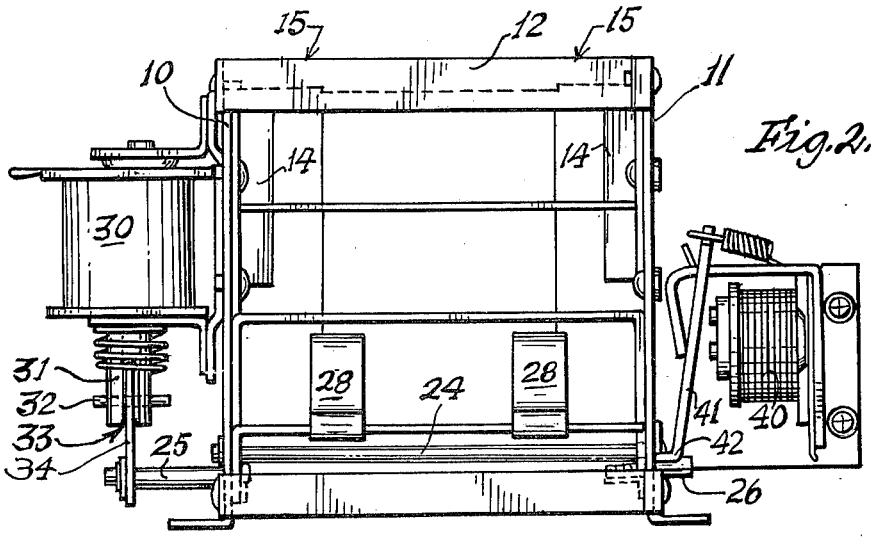
Figure 3:
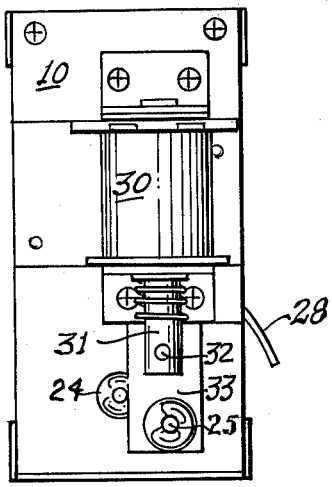
FIG. 3 is an endwise elevation of the dispensing unit showing electromagnetic drive means for actuating the carrier ejector.
Figure 4:
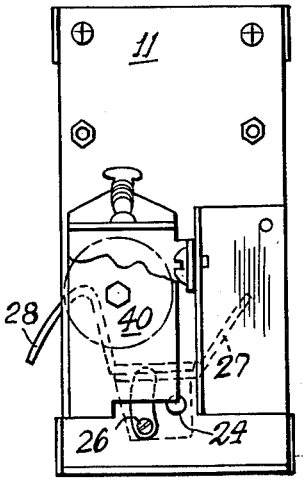
FIG. 4 is an elevational detail of the electromagnetic lockout means disposed on the end of the dispensing unit which is opposite that shown in FIG. 3.

Means for actuating the ejecting cradle may take the form of an electromagnetic solenoid 30 mounted on one of the end plates, as shown in FIGS. 1, 2 and 3, and including a spring-urged plunger 31 coupled to the eccentric cradle pin 25 by a crank plate 34 retained by pin 31 in a slot 33 in the plunger. Responsive to energization of the solenoid 30 by circuit means, to be described, the eccentric crank pin 25 on the cradle will be moved from the normal position seen in FIG. 5 to the operated position shown in FIG. 6 to rock the cartridge dispensing cradle to dispensing position—provided a safety lockout means has first been released, as hereafter explained.

As depicted in FIG. 2, an electromagnetic latching means is provided on the end plate opposite from the dispensing solenoid, and comprises an electromagnet 40 having an armature 41 spring-urged into the normal position seen in FIG. 2 in which an offset latching portion 42 at the end thereof is disposed to overlie and block movement of the eccentric latching stud 26 projecting from the cradle through a slot in the appertaining end plate.

Upon energization of the electromagnet 40 and attraction of its armature 41 the blocking end of the latter is withdrawn and the cradle is free to rock to ejecting position responsive to energization of the actuating solenoid 30, the latching means being effective to guard against fraudulent operation of the bill dispensing unit, as by jarring, probing and the like.

Figure 8:
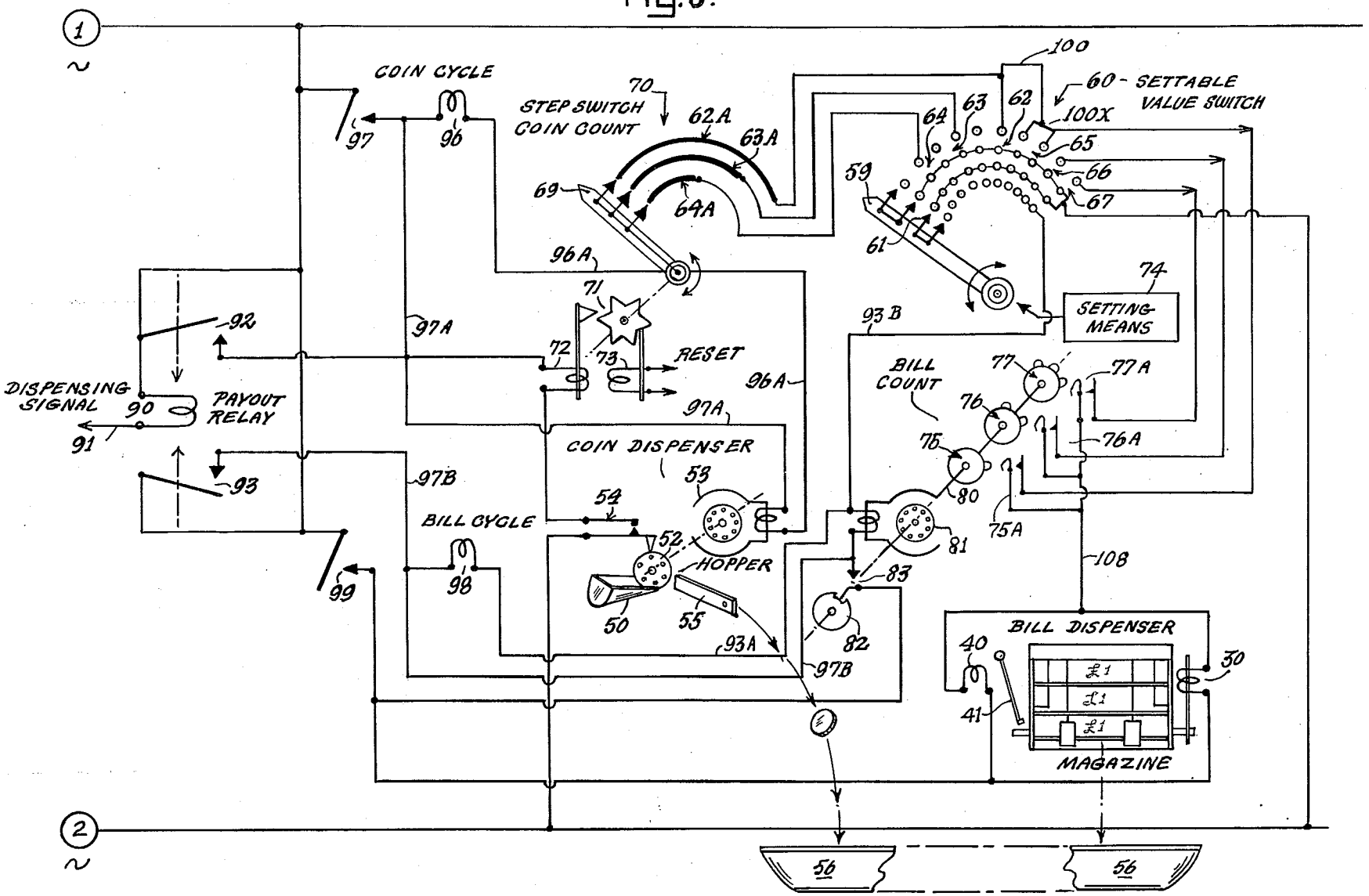
FIG. 8 is a schematic operating and circuit diagram of a preferred form of dispensing system.

The method and dispensing system, according to the schematic operational diagram of FIG. 8, may utilize the well-known hopper type of coin dispenser comprising a coin hopper 50 feeding coins against an inclined rotary transport disc 52 rotated by motor 53 to pick up the coins and transport them serially to a higher level past a counting switch means 54 and thence into a discharge chute 55 for delivery into a receptacle 56.

The number of coins to be dispensed is determined by a value switch means 60 including a movable contactor 59 which can advance from a normal starting position over pairs of contacts 62, 63, 64, governing the hard coinage output, and further pairs of contacts such as 65, 66, 67, governing the soft money or bill payout, such contact pairs being bridged by moving contacts 61 when the contactor 59 comes to rest on some particular pair as an initial step in each dispensing cycle, the contactor 59 being advanced from and returned to normal position by any setting means 74, including manually, if desired, to determine the number of coins to be dispensed.

The pairs of value contacts 62, 63, 64, connect to a motor control switch means 70 of known character (for example, see U.S. Pat. No. 3,273,571) including conductive paths 62A, 63A, 64A, traversed in each dispensing cycle by a movable contactor means 69 rotated from a starting position step-by-step by electromagnetic ratchet means 71, the coil 72 of which is pulsed by the coin switch 54 on the hopper dispenser once for each coin dispensed and maintains the dispenser motor 53 running until the motor switch contactor 69 comes to the end of the particular conductive path enabled by the value switch contact which has in turn been enabled by the value contactor 59, whereupon the motor stops and terminates the payout cycle. The motor control contactor 69 will be automatically reset to starting position by known circuit means (not shown), it being observed that up to this point the construction and operation of the hopper payout mechanism describes known art, except as operative and controlled in the present disclosures.

It may be assumed, for purposes of illustration, that the contact pairs 62, 63, 64, are respectively equivalent in payout-determining value to 20, 50, and 100 coins, and that it is desired that all coinage payouts in excess of 100 coins shall be converted into a soft money payout, so that if the value contactor 59 lodges upon one of the higher-value pairs 65, 66, 67, the hopper payout unit will not operate at all, and instead, the bill-dispensing means will be enabled as by lodgement of contactor 59 on one of the pairs 65, 66, 67, thereby connecting power to enable one of the corresponding pulsing switches 75, 76, or 77, to pulse the lockout coil 40 and the ejecting coil 30 of the bill dispenser, causing ejection, for example, of one (or more) cartridges into the receptacle 56 responsive to turning of the pulsing switch shaft 80 by motor 81 under control of a cycling cam switch means 82, 83, such that rotation of the shaft 80 one revolution under control of the cycling switch 83 will cause pulse cam 75, having only one lobe, to pulse the ejector coils once for ejection of one cartridge; while enablement of the pulse switch 77, having three lobes would cause ejection of three bill cartridges, or cam 76 two cartridges, and so-on in any desired number suited to the size and number of magazines and intended service of the apparatus, by reason of which the pulsing switches constitute a bill-counting means.

If desired, the bill-counting means, such as the pulse switches 75, 76, 77, may each be connected to actuate a separate bill-ejecting unit (not illustrated) in which the respective cartridges may be loaded with more than one bill and:or bills of different denomination, and which therefore may not necessarily be an equivalent substitution for the coin payout which is avoided in either case in shifting of the payout to bills in the higher value range, so that all payouts in excess of some arbitrary number or value of coins are therefore converted in any event to bills of some denomination or number, as desired, whether in one or several bill holders or cartridges.

With reference to FIG. 8 the dispensing cycle is initiated under control of means such as the dispensing or payout relay 90 which will receive a command signal via conductor 91 from any master control or award source, as in a change-making machine or an amusement game dispensing tokens and tickets on a prize award basis, said relay closing contacts 92 and 93 for the purpose of enabling one or the other of two further relays 96 and 98 to operate and establish respective holding circuits at contacts or switches 97 and 99, depending upon the existence of an enabling connection present at the time, as determined by the setting of the value switch 60.

The relay 96 is designated for convenience as the coin cycle relay and will pull in responsive to the payout signal from payout relay contacts 92 provided the value switch has been set on some coin payout contacts in the range including coin contacts such as 62, 63, or 64, thereby establishing an operating connection for the hopper motor 53 via the step switch conductor 96A, power from the source conductor (1) being connected from holding contacts 97 via conductor 97A at this time to start the hopper motor with the result that coins transported by the disc 52 will actuate the coin switch 54 successively and step the movable contactor 69 of the count-down stepping switch means 70 successively as the result of pulsing the stepping ratchet means 71, 72, until the pre-set number of coins has been delivered into the receptacle 56, this dispensing operation being terminated when the movable contactor 69 departs in a last step from whichever variable-length contact path 62A, 63A, 64A, has been enabled by the setting of the value switch contactor 59, so that the holding circuit will be broken to drop out the Coin Cycle Relay 96 and terminate the cycle, contactor 69 being resettable by action of coil 73 as an incident to each payout cycle, in known manner, under control of a master machine circuit.

If it is assumed, instead, that the value switch has been set on some high-value payout contacts, such as 65, 66, or 67, which will be assumed to call for a payout in excess of the arbitrary limit beyond which it is not desired to dispense coins, then the coin cycle relay will not pull in since it will have no enabling connection via any of the coin contacts 62—64, and instead the Bill Cycle Relay 98 will operate via 93A, 93B and owing to the existence of a temporary enabling power connection at relay contacts 93 from the payout relay and applied to the cam switch cycling motor 81 via conductor 97B, which will start the motor 81 and cause instant closure of the cycle cam switch means, 82, 83, it being observed that the payout signal will be only momentary and drop out the payout relay 90 after the Bill Cycle Relay has pulled in and established its holding circuit at contacts 99 and via the holding effect at cycle switch contacts 83.

The cycling cam 82 will make one revolution and reopen cycle switch 83 to drop out the Bill Cycle Relay and terminate the bill-dispensing cycle during which the several bill-dispensing cams 75, 76, 77, having, respectively, one, two and three cam lobes such as will likewise make one revolution to actuate respective bill-payout cam switches 75A, 76A, 77A, one of which will be enabled by the setting of the value switch contactor 59 to enable one of the high-pay value contacts 65, 66, 67, as the result of which one of said cam switches will be pulsed to enable the bill-dispensing unit via conductor 108, thereby energizing the bill-dispensing solenoid 30 simultaneously with the lockout coil 40 to eject one bill cartridge 18 into receptacle 56 if it is assumed that the single-lobed cam switch 75 A is the one enabled as aforesaid; or to dispense two or three cartridges respectively in the case of the switches 76A, 77A, the Bill-Cycle Relay being dropped out, as previously mentioned, when the cycle cam means 82, 83, has completed one revolution of the cam shaft, thereby terminating the bill dispensing cycle.

It is observed that the arrangement of the contacts in the contact field of the value switch means depicted is illustrative and not limiting, and that a variety of payout capabilities and combinations can be provided in various applications of the system as to the number of coin and bill and denominations payouts and combinations possible, as for example, by cross-connecting contacts in the coin and bill ranges, as at 100, FIG. 8 whereby to cycle both of the payout motors responsive to a single dispensing signal, with coins and bills dispensed in the same duty cycle terminated by release of both cycling relays 96 and 98 by their respective holding circuit means 70 and 82–83.

In accordance with a further aspect of the system, tokens or checks may be dispensed by the hopper payout unit and tickets or other paper credit or award memoranda may be loaded into the magazine bill holders in cooperation with score and prize award means in game apparatus of the type shown in U.S. Pat. No. 3,285,380 providing reel-spinning mechanism operative in game cycles to determine the value of a prize award dependently upon the stopping positions of a set of reels bearing symbols representative in various display combinations of award values with corresponding settings of award switch means to pay out tokens or tickets, it being evident that successively large withdrawals of tokens would be as objectionable as that of coins insofar as exhaustion of the supply is concerned.

Figure 9:
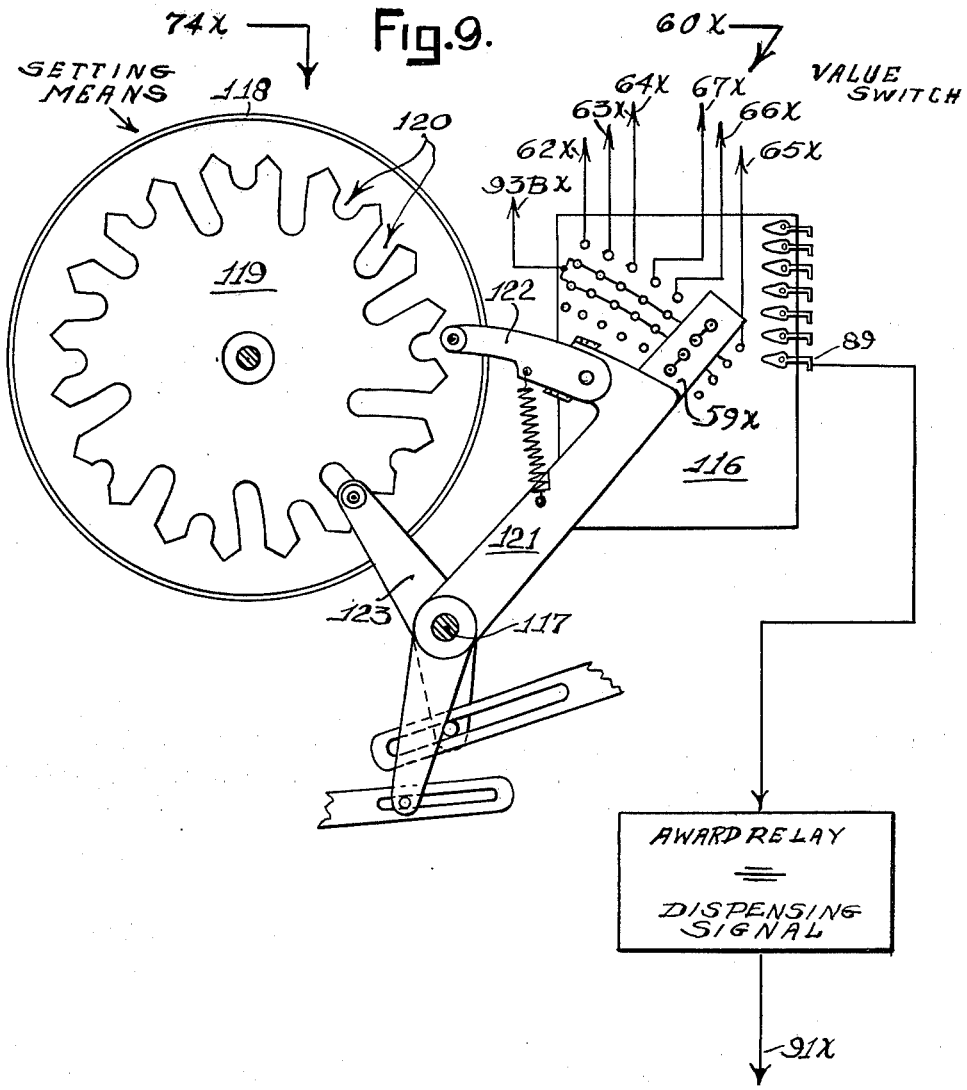
FIG. 9 depicts a modified control arrangement for the value switch.

FIG. 9 illustrates portions of the award switch means forming part of a reel-position decoding means of a type disclosed in U.S. Pat. No. 2,579,241, wherein value-determining contacts are provided on a panel 116 for engagement by a movable selecting contactor 59X pivotable by drive means about a shaft 117 forming part of the known reel-spinning mechanism activated in each game duty cycle to set the reels 118 spinning by action of pawl means 123 in known manner, each reel having rotatable therewith a code disc 119 provided with code formations such as the radial slots 120 of varying value-determining depth. The reels will be arrested near the end of each game or duty cycle by indexing and read-out pawls 122 activated by random timing means (not shown) forming part of the reel-spinning mechanism.

Switch contact carrier levers 121 carry selecting contactors 59X engageable with the field of value contacts on panel 116, and also carry the code-reading and indexing pawls 122 which are adapted to enter the code slots on a chance or random basis near the end of the game cycle with resultant variable positioning of the contactors 59X and possible enablement of award circuits productive of a dispensing signal, via award relay conductor 91X.

There may be numbers of blank or dead contacts in the field or contact array on panel 116, so that every set position of the value contactor means 59X does not necessarily correspond to an award or scoring condition in such an adaptation of the system.

Control of the hopper and magazine dispensers of FIG. 8 by a random type value-setting means such as depicted in FIG. 9, is achieved by replacing the value switch means 60 by the switch means 60X and substituting the connections to contacts 62X–64X and 65X–67X for corresponding connections to contacts 62–64 and 65–67, depicted in FIG. 8. In such a reel arrangement there may be from three to five symbol reels each having associated therewith a decoding or value read-out means 59X, 121 and contact panel 116 arranged as shown in FIG. 9, and an award circuit will be completed as a chain circuit through all of the contact arrays like that on panel 116. For purposes of illustration, it will be assumed that the panel 116 in FIG. 9 represents the last of three such reel units, and that the necessary chain circuit, when completed through all three reel readout or value units, will produce an enabling or award signal at terminal 89, which signal may be utilized as the "dispensing signal" to be applied to conductor 91 in FIG. 8 to initiate a cycle of operation of the dispensing system in one of the possible modes described in view of FIG. 8.

I claim:

1. Currency dispensing apparatus wherein coin-dispensing means is operative to dispense coins in preset numbers from a bulk supply, and bill-dispensing means is operative to dispense bills of predetermined denomination and preset number from a supply source, said dispensing means being operative in dispensing cycles initiated by a dispensing signal and terminated responsive to counting switch means governed by settable value determining switch means operative to determine the number of coins or bills to be dispensed in a given cycle responsive to such signal, characterized in that the value-determining switch means includes settable value contactor means selectively positionable in a field of value contacts wherein coin contacts in one range when engaged by said contactor means enable said coin dispensing means to dispense coins in increasing numbers up to a predetermined arbitrary limit, and bill contacts in another range enable said bill-dispensing means to effect dispensation of bills of predetermined denomination and number dependently upon the positioning of said value contactor in engagement with value contacts in one or the other of said ranges.

2. Apparatus according to claim 1 further characterized in that said bill-dispensing means comprises a magazine adapted to store a supply of bill holders each adapted to contain one or more bills of predetermined denomination; together with holder-ejecting means governed by said bill-counting means and operative to effect ejection from said magazine of a number of said holders as determined by the setting of said value switch contactor means.

3. Currency dispensing apparatus according to claim 1 wherein actuation of the coin-dispensing means is governed by a coin cycle control circuit responsive to said dispensing signal, and said bill-dispensing means is governed by a bill cycle control circuit responsive to said dispensing signal, said value switch means being connected to determine in accordance with the setting thereof which of said coin or bill control circuits is operative to effect dispensing operation of the appertaining dispensing means as aforesaid.

4. Apparatus according to claim 1 further characterized in that one or more special coin and bill contacts in said contact field are connected to effect operation of both the coin and bill-dispensing means responsive to the same dispensing signal in a given dispensing cycle when either of said special contacts is engaged by said value switch contactor means.

5. Dispensing apparatus according to claim 1 wherein said value contactor is manually settable.

6. The dispensing apparatus of claim 1 wherein the value switch contactor means is settable by random-operating selection means operative in duty cycles to change the position of the value contactor means in said contact field as a random event and to produce or not produce a dispensing signal also as a random event.

7. A currency dispensing system wherein coin elements of a given denomination are dispensed from a bulk supply hopper seriatim in dispensing cycles responsive to a payout signal and counted to tally the ordinal count of elements dispensed, the dispensing operation in each cycle being terminated by counting switch means on arriving at a selectably preset number of coin elements under control of presettable selecting switch means characterized in that in addition to means for dispensing coin elements the system includes paper money dispensing means operative to dispense bills or bank notes of predetermined number and value contained in cartridges ejectable from a magazine and selectively operable cartridge-ejecting means responsive to certain operated conditions of said selecting switch means to effect ejection of one or more of said cartridges depending upon the setting of the selecting switch means; said selecting switch means including a plurality of selectable coin-dispensing contacts respectively representative of different numbers of coin elements from 1 to N which can be selectably dispensed where N is a number independent of any monetary value of the coin elements to be dispensed but is also an arbitrarily selected limiting number beyond which the selecting switch means will not cause dispensation of any coin elements at all; said selecting switch means further including bill-dispensing contact means automatically enabled for operation in any given dispensing cycle as the result of the selecting switch means being actuated to a selecting condition which does not select a contact corresponding to a number of coin elements lying between 1 to N inclusive.

8. A payout system for game apparatus controlled by chance-operating selection switch means wherein coins of a given denomination are paid out sequentially in various numbers from a bulk supply hopper by coin dispensing means operating in duty cycles which are initiated by a payout signal derived from chance-operating spinning reel switch means in conjunction with counting switch means operative in each such cycle to effect a count of coin elements dispensed in accordance with the command of said reel switch means and a selective value-switch means governed by said spinning reel means in such cycle, characterized in that the system includes means for dispensing soft money in the form of bank notes and like currency in predetermined denominations dependently upon certain operated conditions of said value switch means in any given cycle, said value switch means including at least first and second ranges of value contacts scanned progressively in each cycle by contactor means operative to effect actuation of the coin dispensing means when said contactor means is within said first range whereby to effect dispensation of a selected number of coins determined by the selector switch means and ranging from 1 through N where N is an arbitrary limiting number bearing no essential or limiting relation to the monetary value of coin elements being dispensed, but constituting a limiting number beyond which no coin elements whatever will be dispensed in any given duty cycle; said contactor means in at least some positions in the second range of value contacts being operative to initiate operation of said bill dispensing means whereby the number of coin elements dispensed in any cycle will never be greater than N and bills can be paid out in any cycle in which the selector switch means is in some selecting position beyond the limiting number N and in the second range.

* * * * *